US005758474A

United States Patent [19]

Ziegler

[11] Patent Number: 5,758,474

[45] Date of Patent: Jun. 2, 1998

[54] APPARATUS FOR LOADING STACKED ARTICLE GROUPS INTO CARTONS

[75] Inventor: Kelly W. Ziegler, Crosby, Minn.

[73] Assignee: Riverwood International Corporation, Atlanta, Ga.

[21] Appl. No.: 824,511

[22] Filed: Mar. 26, 1997

Related U.S. Application Data

[60] Provisional application No. 60/016,930, Mar. 26, 1996.

[51] Int. Cl. [6] ..... B65B 35/50

[52] U.S. Cl. ..... 53/447; 53/475; 53/566; 53/153; 53/540; 53/252

[58] Field of Search ..... 198/429, 430; 53/152, 153, 251, 252, 258, 259, 447, 448, 475, 566, 540, 543

[56] References Cited

U.S. PATENT DOCUMENTS

| | | | |
|---|---|---|---|
| 3,107,013 | 10/1963 | Euwe | 53/152 X |
| 3,201,912 | 8/1965 | Wozniak | 53/153 X |
| 3,994,387 | 11/1976 | Zappia | 198/430 X |
| 4,003,464 | 1/1977 | Zappia | 198/430 X |
| 4,081,073 | 3/1978 | Zappia | 198/430 |
| 4,817,779 | 4/1989 | Beck et al. | 53/252 X |
| 5,079,896 | 1/1992 | Langen et al. . | |
| 5,092,449 | 3/1992 | Bolin et al. | 198/430 |
| 5,241,806 | 9/1993 | Ziegler et al. . | |
| 5,347,796 | 9/1994 | Ziegler et al. . | |
| 5,369,942 | 12/1994 | Olson . | |
| 5,437,143 | 8/1995 | Culpepper et al. . | |
| 5,454,206 | 10/1995 | Bailer et al. | 53/258 X |
| 5,456,058 | 10/1995 | Ziegler . | |
| 5,472,077 | 12/1995 | Bolin | 198/430 |
| 5,477,655 | 12/1995 | Hawley | 53/566 X |
| 5,628,614 | 5/1997 | Pazdernik et al. | 198/430 X |
| 5,638,663 | 6/1997 | Robinson et al. . | |
| 5,666,789 | 9/1997 | Ziegler | 53/566 X |
| 5,692,361 | 12/1997 | Ziegler et al. | 53/566 X |

*Primary Examiner*—Daniel Moon

*Attorney, Agent, or Firm*—Joel D. Skinner, Jr.; Marvin L. Beekman; Steve M. McLary

[57] ABSTRACT

An apparatus for loading stacked article groups into cartons in a continuous motion cartoner assembly. The barrel cam loading apparatus or article group transport mechanism is particularly suited to loading article groups that are unstable or whose articles tend to spin and kick article out of the carton. The article group transfer mechanism loads the stacked group by having the lower article group lead the upper article group which tends to make the articles tip backward into a stable contact with the article group transfer mechanism and by forming the upper article group into a nested configuration which has a thinner loading dimension and resists kicking out an article The transfer mechanism comprises plurality of transfer elements disposed at predetermined longitudinally spaced intervals, the transfer elements being for laterally moving article groups which are being longitudinally transported in a stream, each transfer element including a lower contact member and an upper stepped contact member, a support member connected to the contact members, and a control member for directing the lateral movement of the transfer elements.

9 Claims, 9 Drawing Sheets

APPARATUS FOR LOADING STACKED ARTICLE GROUPS INTO CARTONS

STATEMENT REGARDING FEDERALLY SPONSORED RESEARCH OR DEVELOPMENT

Not Applicable.

REFERENCE TO A MICROFICHE APPENDIX

Not Applicable.

CROSS-REFERENCE TO RELATED APPLICATIONS

This is application claims the benefit under 35 USC §199(e) of co-pending provisional application Ser. No. 60/016,930, filed Mar. 26, 1996, now abandoned.

BACKGROUND OF THE INVENTION

1. Field of the Invention

The present invention relates, generally, to apparatus and methods used in the packaging industry. More particularly, the invention relates to an article group transfer mechanism for use in continuous motion cartoner assemblies which load stacked or two-tier article groups into cartons or packages. The article group transfer mechanism, or barrel cam loader, is a side or cross loading-type device. The present invention has particular utility in loading relatively unstable stacked article groups into paperboard or other cartons in a fast and reliable manner. Stacked bottles are an example of this instability because the top layer of bottles are resting on the relatively small tops of the bottom bottles. The present invention also has utility in loading imperfectly round articles or other articles that have a tendency to spin during the loading process. However, the invention also may have utility in other applications.

2. Background Information

In the past, various devices and methods have been used or proposed to load article groups into carton or other packaging sleeves, blanks or wraps in a cartoner or other packaging machine. However, these devices and methods are believed to have significant limitations and shortcomings. One problem occurs when a cartoner loads relatively unstable stacked article groups into carton sleeves. For example, a group of bottles is unstable because the upper group of bottles tends to tip or tilt on the smaller tops of bottles in the lower group. The instability of the upper group may interfere with the loading of articles groups and may cause the upper articles to fall out of the carton before the carton ends are closed and the articles are secured in the carton. Another problem occurs when imperfectly round articles, such as labeled bottles, are pushed or loaded into cartons. When rows of these imperfect articles are loaded into a tight carton sleeve, the friction between the outside rows of articles and the side walls of the carton sleeves causes the outside articles to rotate or spin toward the side walls of the carton sleeves. The spinning of the outside articles tends to kick the middle row of articles forward and may cause the middle articles to fall out of the carton sleeve before the carton ends are closed.

Examples of devices upon which the article group transfer mechanism of the present invention may be used are described in U.S. Pat. No. 5,456,058 (hereinafter referred to as "Patent '058"), U.S. Pat. No. 5,241,806 (hereinafter referred to as "Patent '806"), and U.S. Pat. No. 5,347,796 (hereinafter referred to as "Patent '796"). Patent '058, Patent '806, and Patent '796 are all assigned to applicants' assignee and are all hereby incorporated by reference.

Patent '058 discloses a continuous motion cartoner assembly for loading stacked or vertically layered article groups into cartons. The cartoner assembly comprises an article infeed mechanism supplying at least two streams of articles at vertically distinct levels; an article group selection and transport mechanism intersecting the article infeed mechanism to form a longitudinal stream of article groups of a predetermined stacked pattern; a carton supply and transport mechanism synchronized and moving parallel with the article group selection and transport mechanism to provide cartons with open ends facing the moving article groups; and an article group transfer mechanism constructed and arranged to move the article groups into the open ends of the carton sleeves. This cartoner provides a method of continuously loading cartons with stacked article groups having upper and lower sub-groups of at least one article. The method comprises the steps of supplying an input stream of articles at a first location, selecting articles at the first location to form a lower article sub-group, transporting the lower article sub-groups longitudinally to a second location, supplying an input stream of articles at the second location, selecting articles at the second location to form an upper article sub-group on top of the lower article sub-group to thereby form a stacked article group, supplying and longitudinally transporting a carton in spacial synchronization with the stacked article group, and laterally transferring the stacked article group into the longitudinally transported carton.

Patent '806 discloses a cartoner assembly for loading article groups into open carton sleeves. It is used to load unstacked bottles or cans into carton sleeves. The cartoner assembly comprises an article infeed mechanism supplying at least one stream of articles, an article selection mechanism intersecting said article infeed mechanism to form and move a stream of article groups of a predetermined pattern, a carton transport mechanism synchronized and moving parallel with said article selecting mechanism to provide cartons with open ends facing said moving article groups, and an article groups transfer mechanism constructed and arranged to move article groups into the open ends of the carton sleeves. The article selection mechanism has a plurality of transversely fixed, stationary flight bars disposed thereon which linearly select articles from the article infeed mechanism which is angled with respect to the article selection mechanism. The article group transfer mechanism has transversely reciprocating arm assemblies, including cam actuated stepped transfer heads, for loading product groups in an initially nested configuration having a differentially thinner loading dimension. The article groups transfer mechanism includes cam actuated means to guide product groups into cartons. The carton transport mechanism has improved carton flight phase adjustment means.

Patent '796 discloses an article group transfer mechanism constructed and arranged to move article groups into open ends of the carton sleeves. The mechanism is incorporated in a continuous motion cartoner assembly, or cartoner, for loading article groups into cartons. The cartoner comprises: an article infeed mechanism supplying at least one stream of articles; an article group selection and transport mechanism intersecting the article infeed mechanism to form and transport a longitudinal stream of article groups of a predetermined pattern; a carton supply and transport mechanism synchronized and moving parallel with the article group selecting mechanism to provide cartons with open ends facing the moving article groups; and an article group transfer mechanism. The article group transfer mechanism is constructed and arranged to move the article groups into the open ends of the carton sleeves. One embodiment of the article group transfer mechanism provides a lateral transfer apparatus that comprises: a frame structure; a plurality of transfer elements disposed at predetermined longitudinally spaced intervals wherein the transfer elements laterally move articles which are being longitudinally transported in at least one stream of the article processing system, each transfer element including a stepped contact member for moveable contact with the articles; a support member connected to the contact member; and a control member for directing the lateral movement of the transfer elements, the control member including a first cam follower connected to the support member wherein the first cam follower controls the lateral movement of the transfer elements, and further including a second cam follower pivotally connected to the support member and connected to the contact member via linkage means wherein the second cam follower provides differential lateral movement to the stepped contact member; means, connected to the support member, to longitudinally move the transfer elements; and a cam track assembly capable of laterally moving the transfer elements, and which is cooperatively mated with the first and second cam followers.

Despite the need in the art for a continuous motion carton assembly which overcomes the disadvantages, shortcomings and limitations of the known art, none insofar as is known has been developed. Accordingly, it is an object of the present invention to provide an article group transfer mechanism that maintains the stability of upper article groups, especially during the stacking of articles with a smaller top than bottom. Another object is to provide an article group transfer mechanism that successfully loads articles that tend to spin during the loading process by using article group transfer structures having transversely reciprocating arm assemblies with cam actuated stepped transfer heads. The stepped transfer heads loads article groups in an initially nested configuration having a differentially thinner loading dimension.

BRIEF SUMMARY OF THE INVENTION

The present invention provides an apparatus for loading stacked article groups in cartons, or an article group transfer mechanism, in a continuous motion cartoner assembly or cartoner constructed and arranged to move stacked article groups into open ends of carton sleeves. In a preferred embodiment, the transfer mechanism comprises a plurality of transfer elements disposed at predetermined longitudinally spaced intervals, the transfer elements being for laterally moving article groups which are being longitudinally transported in a stream, each transfer element including a lower contact member and an upper stepped contact member, a support member connected to the contact members, and a control member for directing the lateral movement of the transfer elements. The control member includes: a first cam follower connected to the support member, the first cam follower controlling the lateral movement of the transfer elements; a second cam follower pivotally connected to the support member and to the contact member via linkage means, the second cam follower providing differential lateral movement between the upper and lower contact members; and a third cam follower pivotally connected to the support member and further being connected to the contact member via linkage means, the third cam follower providing differential lateral movement to predetermined portions of the stepped contact member. The control member further includes means, connected to the support member, to longitudinally move the transfer elements and a cam track assembly capable of laterally moving the transfer elements because it is cooperatively mated with the first, second and third cam followers.

The article group transfer mechanism of the present invention solves the problems associated with the known art. It offsets the articles located in the upper layer in relation to the articles in the lower layer so that the articles in the upper layer are stable because they tend to tip backwards toward the contact member. Thus, the present invention prevents the articles from tilting forward and exiting through the back of the carton sleeve prior to closing the carton sleeve ends. Additionally, it offsets the middle row of articles in relation to the outside rows of articles so that the spinning of imperfectly round articles in the outside rows will not kick the articles in the middle row forward.

The features, benefits and objects of this invention will become clear to those skilled in the art by reference to the following description, claims and drawings.

DETAILED DESCRIPTION

Figure 1:
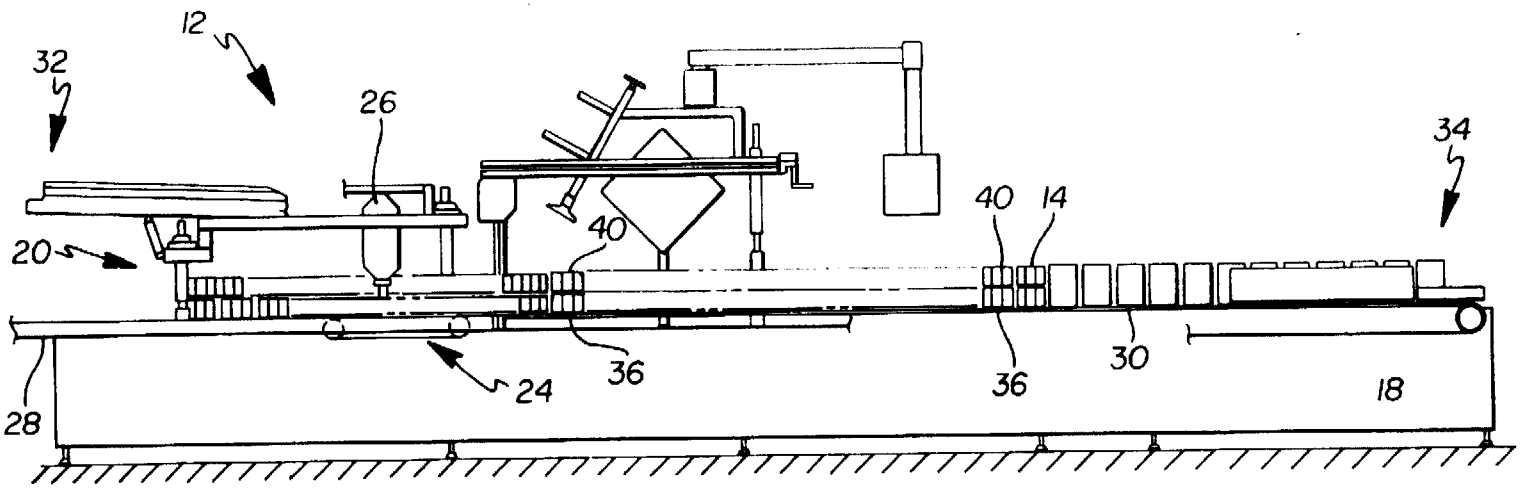
FIG. 1 is a side view of an article cartoning apparatus which includes an article loading mechanism of the present invention.
Figure 2:
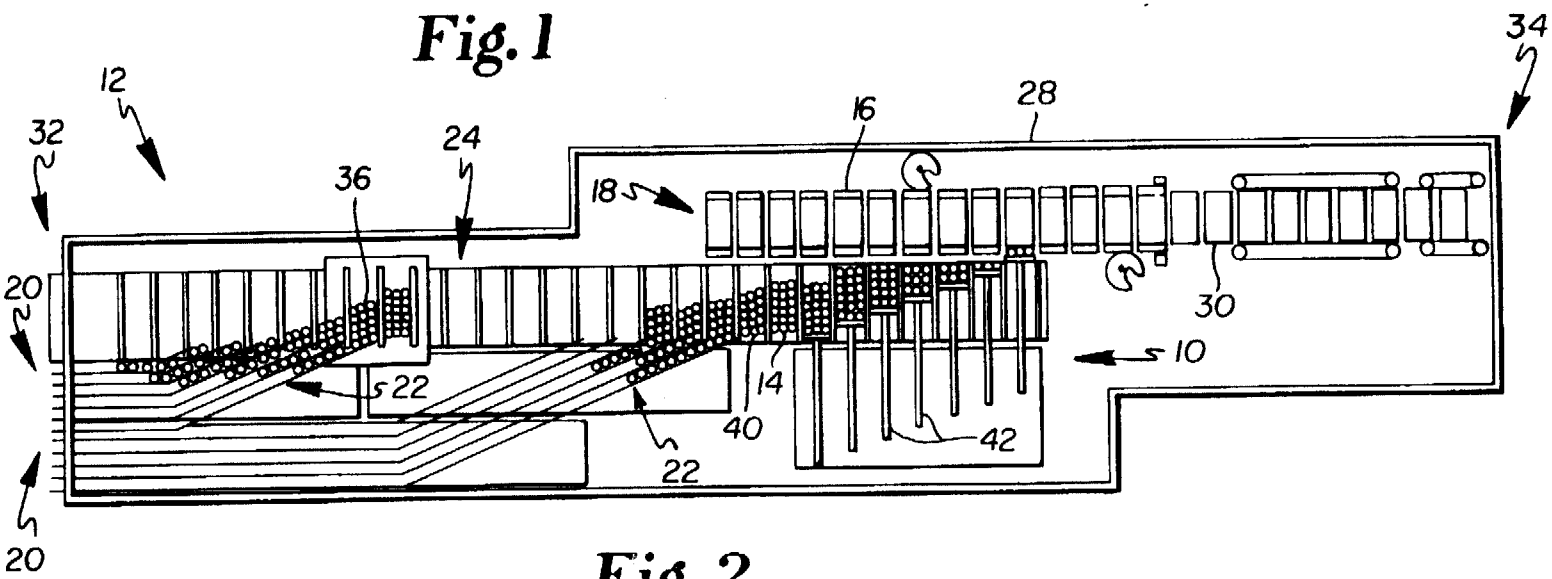
FIG. 2 is a top plan view of the cartoning apparatus of FIG. 1.
Figure 3:
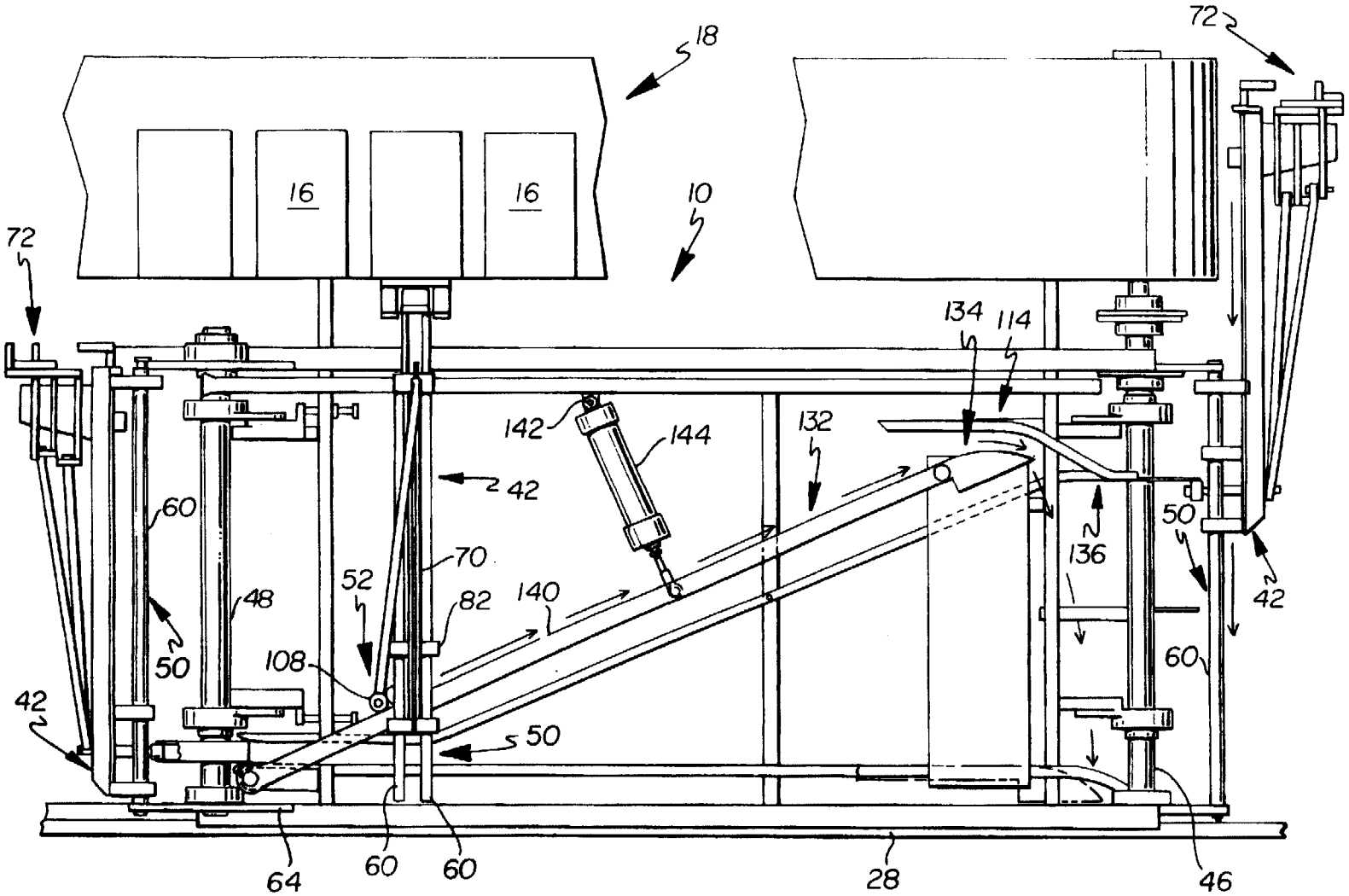
FIG. 3 is a top view of the article group loading mechanism.
Figure 4:
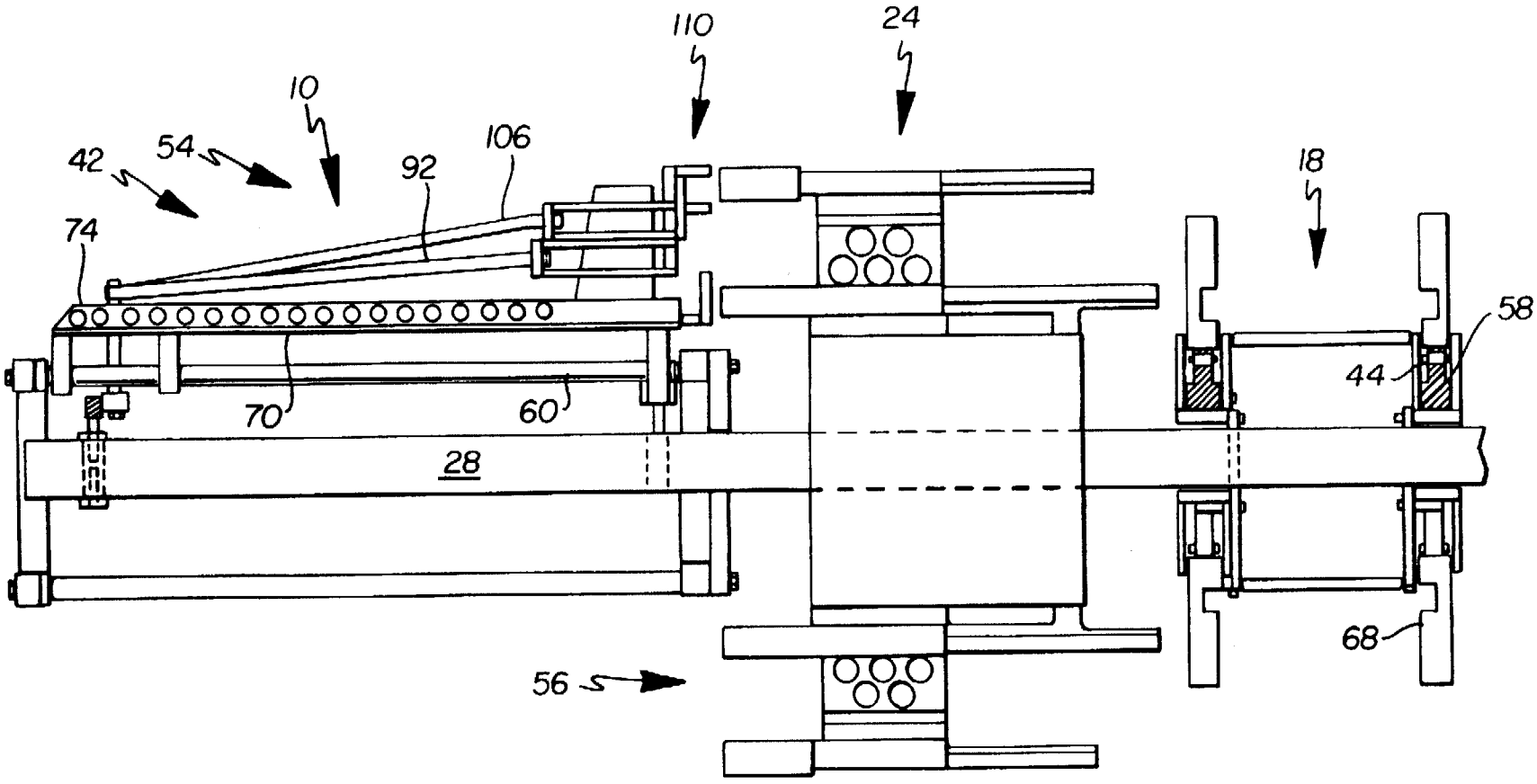
FIG. 4 is an end view of the article group loading mechanism.
Figure 5:
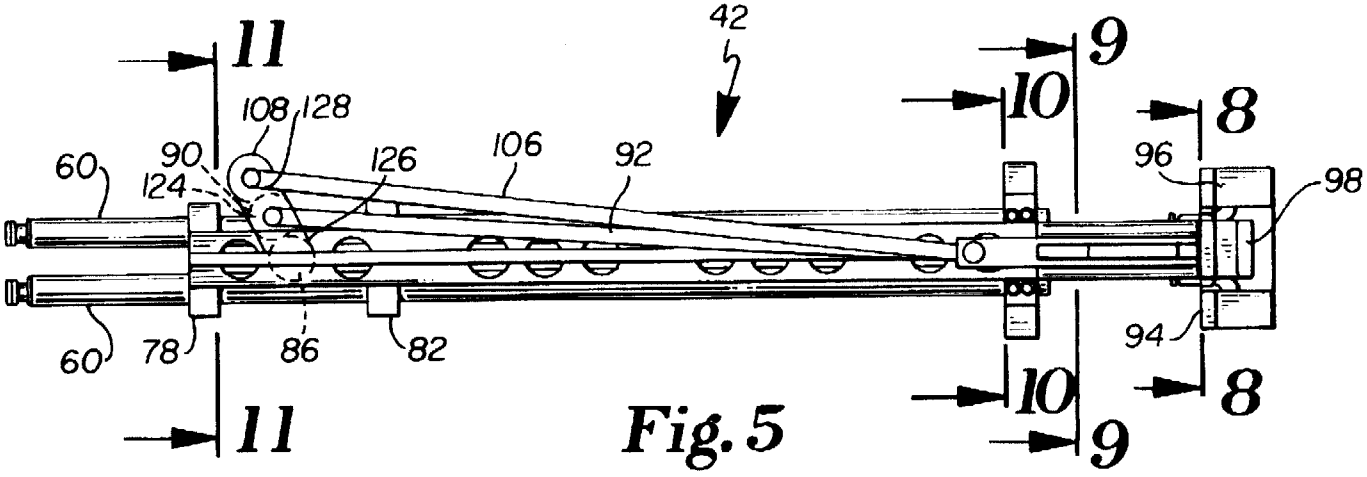
FIG. 5 is a top plan view of the loader arm assembly of the present invention.
Figure 6:
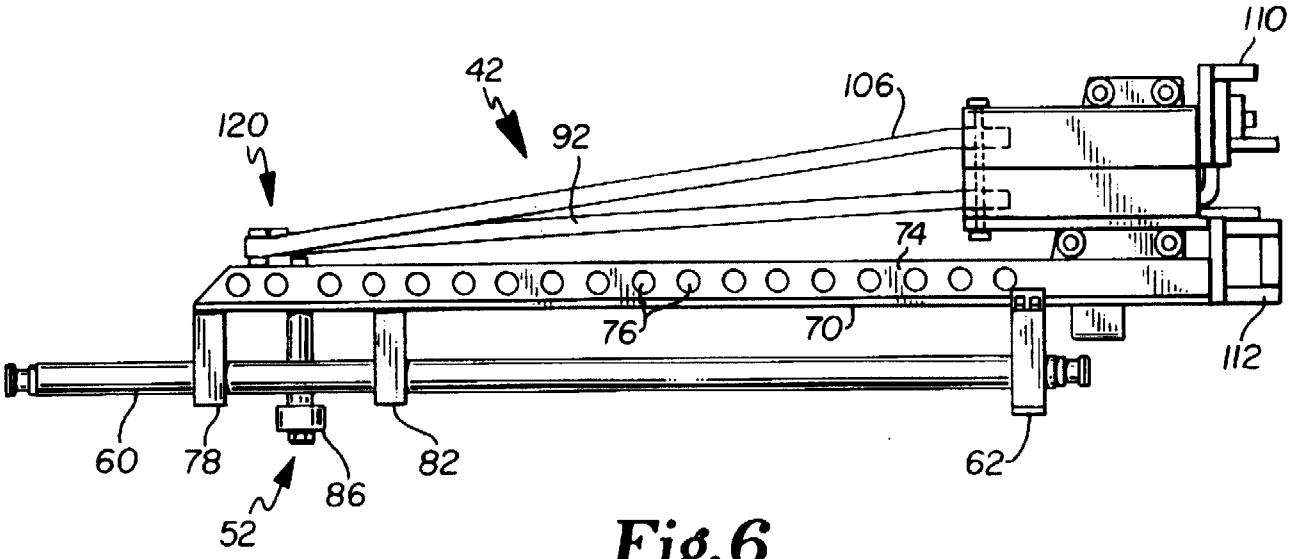
FIG. 6 is a side view of the loader arm assembly of FIG. 5.
Figure 9:
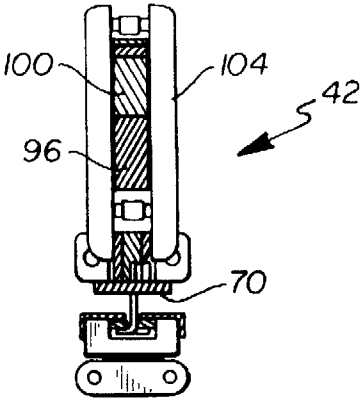
FIG. 9 is a cross-sectional view along line 9—9 of FIG. 5.
Figure 8:
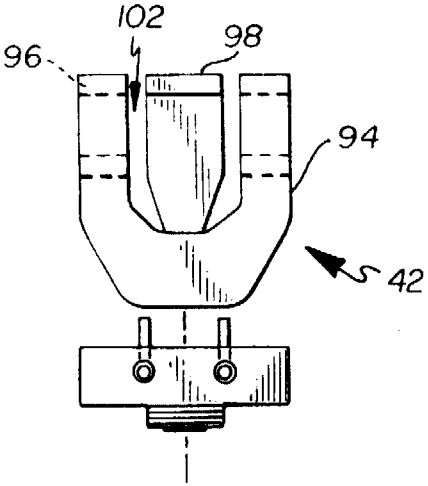
FIG. 8 is a cross-sectional view along line 8—8 of FIG. 5.
Figure 7:
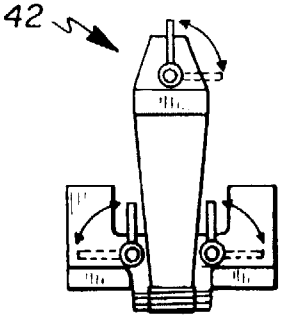
FIG. 7 is an end view of the loader arm assembly of FIG. 5.
Figure 11:
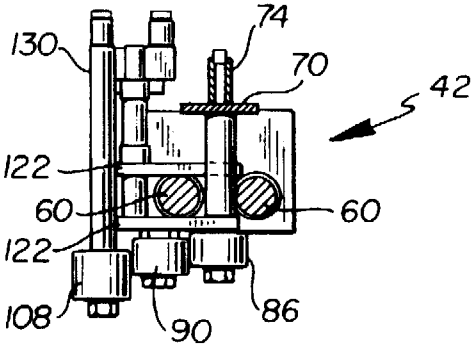
FIG. 11 is a cross-sectional view along line 11—11 of FIG. 5.
Figure 10:
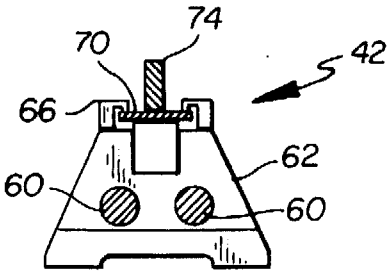
FIG. 10 is a cross-sectional view along line 10—10 of FIG. 5.
Figure 12:
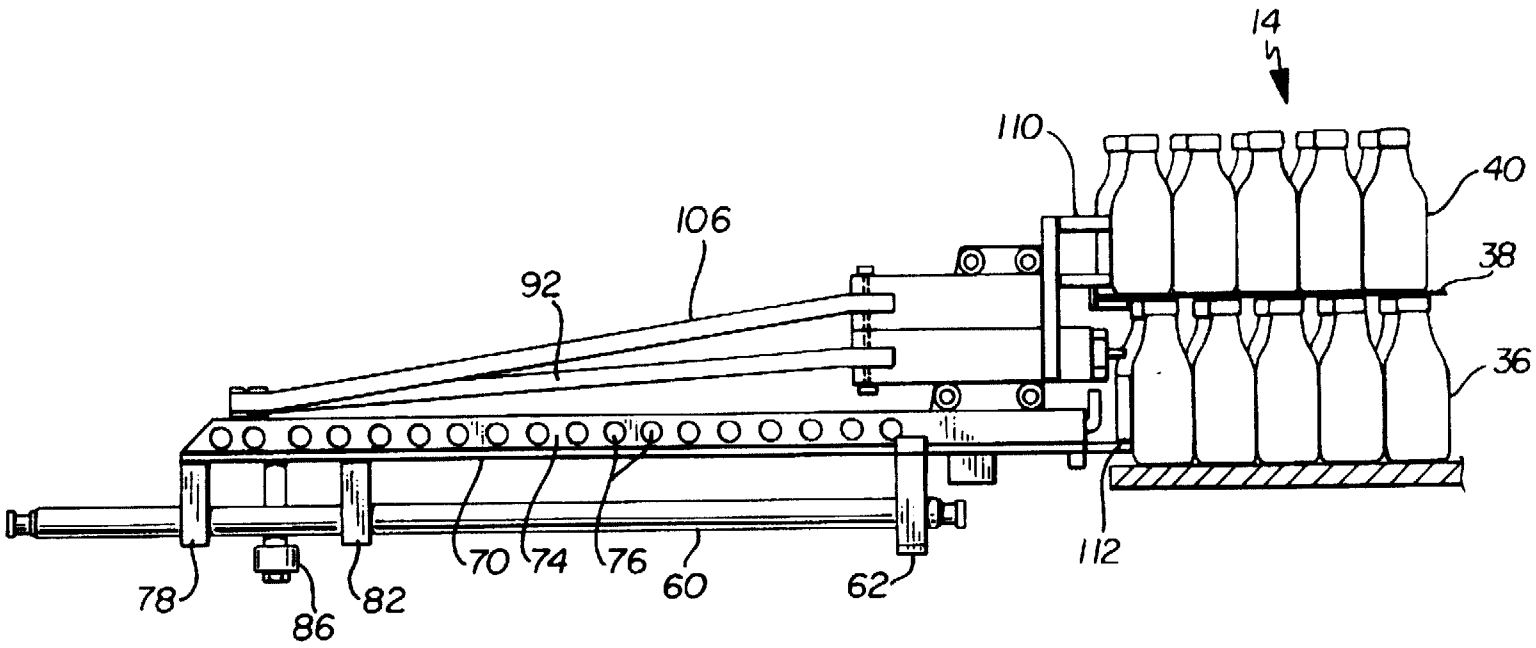
FIG. 12 is a side view of an embodiment of a loader arm assembly shown loading nested, stacked groups of bottles.
Figure 13:
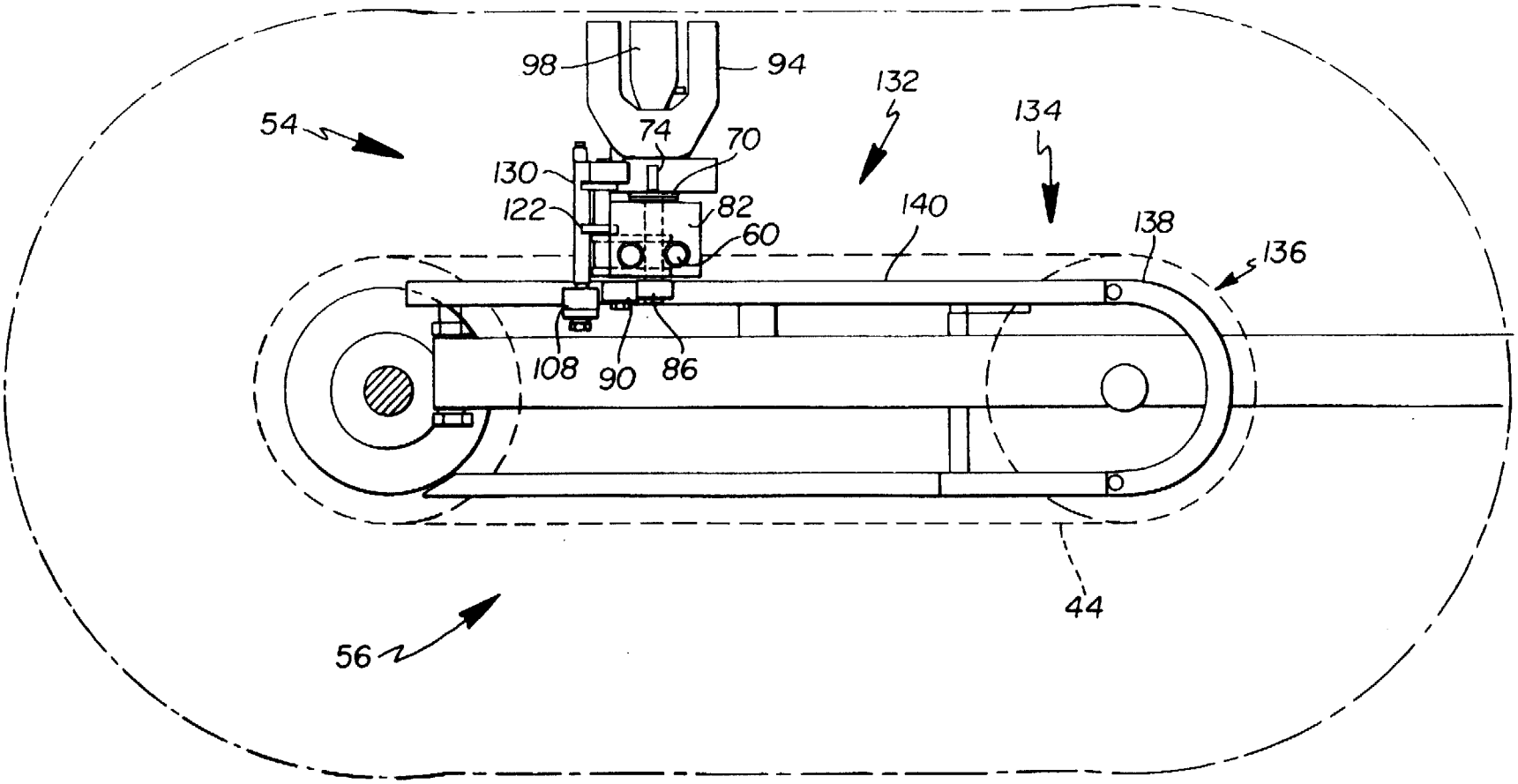
FIG. 13 is a cross-section view of the cam rails of article group loading mechanism.
Figure 14:
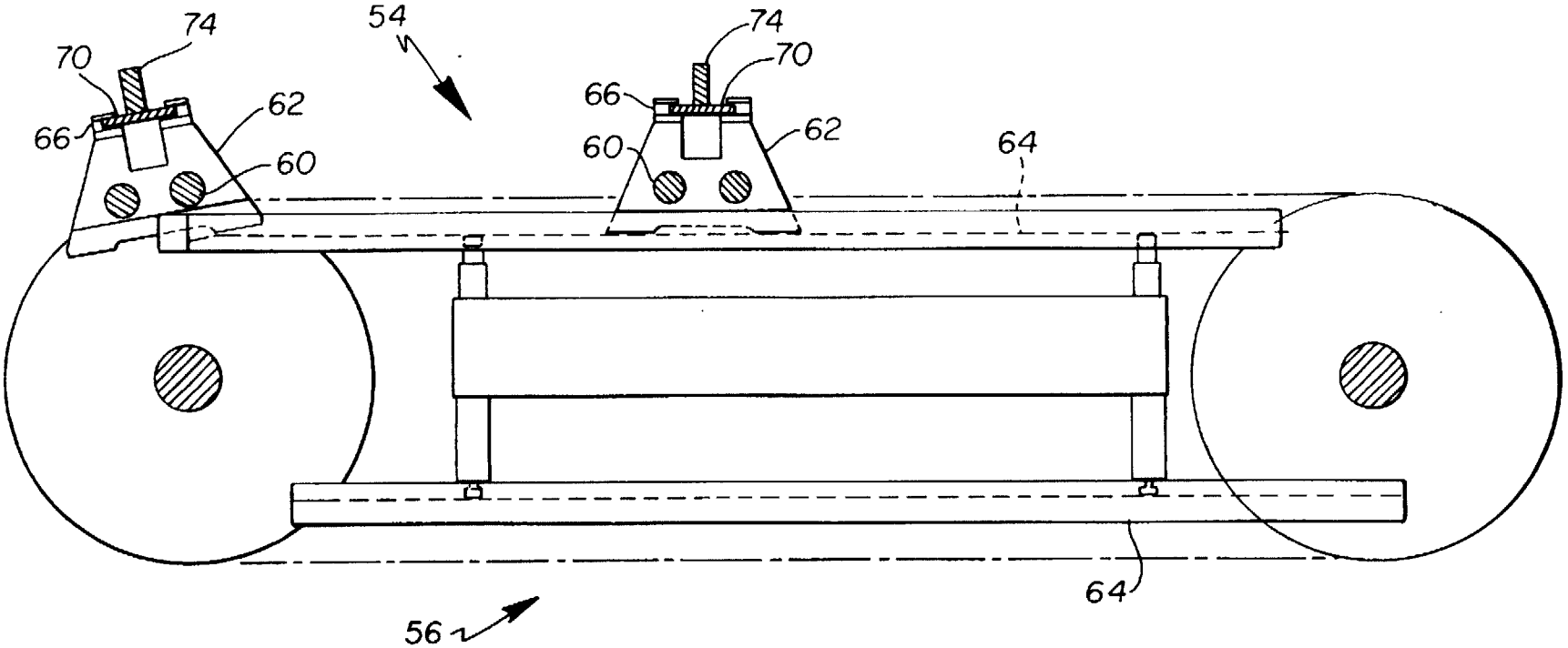
FIG. 14 is a cross-sectional view of the guide rails of the article group loading mechanism.
Figure 15:
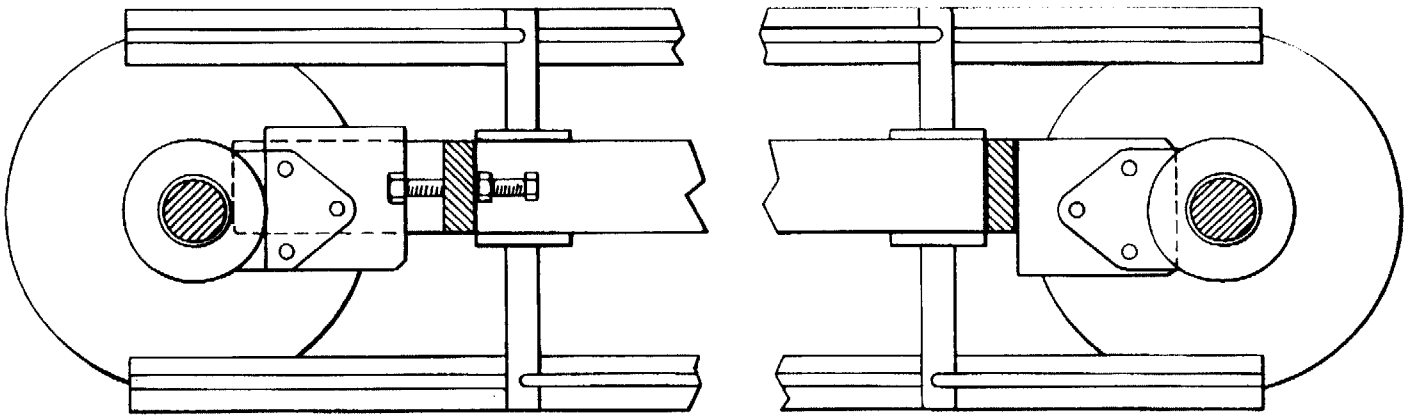
FIG. 15 is a cross-sectional view of the loader chain guides.

The apparatus for loading stacked article groups, or article group loading mechanism 10, is used in a continuous, high-speed cartoning apparatus or cartoner 12. FIGS. 1 and 2 show the cartoner 12 loading stacked bottle groups 14 into paperboard carton sleeves 16 and producing cartons 30. The cartoner 12 generally comprises a carton transport mechanism 18, a pair of article infeed mechanisms 20, an article group selection mechanism 22, an article group transport mechanism 24, a divider placement mechanism 26, and an article group loading mechanism 10. These mechanisms are supported by a unitary frame structure 28. The article group loading mechanism 10 cooperates with and is synchronized to both the carton transport mechanism 18 and article group transport mechanism 24 of the cartoners 12.

Carton sleeves 16 or blanks are disposed on the carton transport mechanism 18 and are subsequently transported in a linear fashion to an output end 34 of the cartoner 12. The article infeed mechanisms 20 are shown to be disposed at the input end 32 of the of the cartoner 12. A first portion of each article infeed mechanism 20 is disposed spacially parallel to the article group selection mechanism 22 and the article group transport mechanism 24, and a second portion merges, at a predetermined angle, with the article group transport mechanism 24 to supply streams of articles to two separate positions along the article group transport mechanism 24. These merging mechanisms 20 and 24 are further constructed and arranged to meter individual articles using flight bars into predetermined stacked article groups 14 on the mechanism. The stacking function of the device is accomplished by forming a first or lower group 36 at a low level, placing a separator or divider sheet 38 on the lower group 36 via the divider sheet placement mechanism 26, and then simultaneously forming a second or upper group 40 downstream at an upper level and allowing the upper group 40 to slide across the divider sheet 38 by the action of the flight bars of the article group selection mechanism 22. The article group transport mechanism 24 is disposed adjacent and parallel to the carton transport mechanism 18 and downstream in a linear orientation. Merged or stacked article groups 14 are transported downstream thereon in a spaced and metered fashion, each group 14 being aligned with a carton sleeve 16 traveling on the carton transport mechanism 18. The article group loading mechanism 10 has loader arm assemblies 42 which extend transversely or perpendicularly with respect to the transport mechanisms 18 and 24, and move stacked article groups 14 on the article group transport mechanism 24 into the aligned carton sleeves 16 traveling on the carton transport mechanism 18, thereby loading the carton sleeves 16 with the stacked article groups 14. Preferably, each of the aforementioned mechanisms has a conveyor type structure with an endless flight chain or belt 44 configured about rotatable idler 46 and drive 48 end means and moves longitudinally with respect to the input 32 (upstream) and output 34 (downstream) ends of the cartoner. The movement of each mechanism is further synchronized with one another, for example by a common drive and/or gearing means.

The article group transfer mechanism 10 or barrel cam loader of the present invention is synchronized with the aforementioned apparatus elements to move stacked article groups 14 traveling on the article group transport mechanism 24 into aligned carton sleeves 16 traveling on the carton transport mechanism 18. As shown in FIGS. 3–15, the article group transfer mechanism 10 basically comprises a plurality of loader arm assemblies 42, a flight chain and guide tube assembly 50 to which the loader arm assemblies 42 are attached at predetermined intervals, and which provides a longitudinal movement component thereto, and a control cam assembly 52 which provides a predetermined transverse motion component to the loader arm assemblies 42.

The flight chain and guide tube assembly 50 has a downstream or top run 54 and a return or bottom run 56 and comprises idler 46 and drive 48 end means and a pair of spacially parallel flight chains 44 which are connected to and revolve about the idler 46 and drive 48 end means. The flight chains 44 are maintained in a rectilinear configuration on both the top 54 and bottom 56 runs by chain guides 58, which are linked to the frame 28 via vertical support members.

Pairs of guide tubes 60 are disposed at predetermined intervals along the flight chains 44, each guide tube 60 being directly connected at one end to the outer flight chain, and at its opposite end to the inner flight chain so that they are oriented transversely with respect to the axis of the cartoner 12 and to the downstream or top run 54 of the article group transfer mechanism 10. The guide tubes 60 have a low friction exterior surface to provide slidable support of the loader arm assemblies 42. Further stability is attained by the guide blocks 62 (connected to the inner ends of the guide tubes 60 via set screws) traveling in a longitudinal oriented guide rail 64 which is linked to the frame 28 via a support. Lateral retainers 66 are mounted on the top of each guide block 62 to guide the transversely moving loader arm assemblies 42. The spacing between successive sets (pairs) of guide tubes 60 corresponds to the spacing between the flight bars of the article group transport mechanism 18 and of the flight lugs 68 of the carton transport mechanism 18 so that the loader arm assemblies 42 are aligned to push article groups 14 from between the flight bars into the carton sleeves 16.

The loader arm assemblies 42 are movably mounted on the guide tubes 60, and in a transverse orientation with respect to the axis of the cartoner 12. The loader arm assemblies 42 are conveyed in a downstream, longitudinal direction while they simultaneously reciprocate in a transverse direction influenced by the control cam assembly 52 described below. Each loader arm assembly 42 basically comprises an elongated, rectilinear base plate 70 and a loading head 72 located at one end of the base plate 70. The base plate 70 is shown to have a rigid, flat, elongated structure which is oriented horizontally. A rigid stifling bar 74 is connected to the top surface of the base plate 70 and is vertically oriented to increase the rigidity and strength of the arm assembly 42. Preferably, a plurality of bores 76 are disposed in the base plate 70 and stiffing bar 74 to reduce weight. The inwardly disposed end of the base plate 70 is slidably supported by the lateral retainers 66 of the guide block 62. A first or outer bushing block 78 is connected to the bottom of the base plate 70 at its opposite end. The first bushing block 78 has a pair of apertures, including bushings, through which the guide tubes 60 are slidably extended. A second or inner bushing block 82 is similarly connected to the base plate 70 and interfaces with the guide tubes 60 a short distance from the first bushing block 78. The bushing blocks 78 and 82 are further connected by a spreader bar which is oriented and rides in the space between the guide tubes 60. A rotatable first cam follower 86 is connected to the bottom of the spreader bar 84. The longitudinally traveling first cam follower 86 cooperates with the rails of the control cam assembly 52 to cause the loader arm assembly 42 elements to transversely reciprocate on the guide tubes 60 and through the lateral retainers 66 of the guide blocks 62.

The loading head 72 has one or more fixed face members 96 and one or more extensible face members 98. The term "fixed face member" does not indicate a lack of motion in the face member, because it has lateral and longitudinal motion. Rather, as will be described later, it is meant to distinguish the fixed face member from the extensible face member with respect to their differential motion. The fixed face members 96 are connected to a backing plate 94. The backing plate 94 is pivotally connected to the connecting bar via a backing connection rod 92. A rotatable second cam follower 90 cooperates with the rails of the control cam assembly 52 to cause the backing plate 94 and fixed face members 96 to extend. The extensible face member 98 has a rear or tail portion 100 which extends through an aperture 102 in the backing plate 94 and is laterally supported by vertical supports 104. The tail portion 100 is pivotally connected to the connecting bar via an extensible connection rod 106. A rotatable third cam follower 108 is connected to the extensible connecting rod 106 and cooperates with the cam guide assembly 88 to cause the extensible face member 98 to extend.

Figure 17:
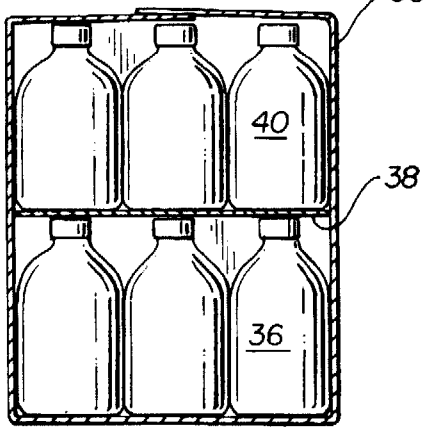
FIG. 17 is a cross-sectional view along line 17—17 of FIG. 16 showing a stacked article group.
Figure 16:
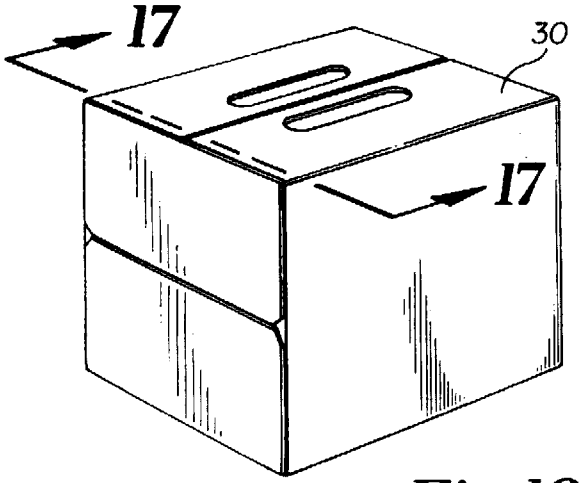
FIG. 16 is a perspective view of an example of a paperboard carton processed by the mechanism of the present invention.

Each face member 96 and 98 contacts an individual article located and exposed for contact at one end of the article group 14. Since the articles are arranged in rows, as the loader arm assemblies 42 move forward, the face members 96 and 98 push the rows of articles forward from the article transport mechanism 24 into the cartons 30. Additionally, the face members 96 and 98 are shown to be stepped or staggered so that the adjacent rows of articles are also staggered or unaligned. In this configuration, the relatively cylindrical or round articles in adjacent rows rest closer to one another than they would when aligned. Hence, the width of the nested article groups is less than that of the aligned groups. This decreased article group width is exploited during carton loading to improve article group ingress reliability and speed. Subsequent to loading, this nested article group configuration is altered, as described below, to provide a taut, fully loaded, carton with minimum wasted space as shown in FIGS. 16 and 17. The differential article group configuration provided by the stepped, actuatable loading head 110 is particularly beneficial given normal carton and beverage container manufacturing tolerances. Also, taut, fully loaded, cartons 30 are more stable for improved storage and handling, with less article shifting and breakage. This is especially desirable in glass beverage containers. The loading head 72 of a preferred embodiment of the invention includes an upper stepped loader head 110 as previously described, and a lower flat loader head 112. The upper stepped loader head 110 forms a nested article group which has thinner loading dimensions and is easier to load into carton sleeves 16. Furthermore, the middle row of articles is lagging the outside rows of bottles, and thereby will not be kicked forward by the spinning bottles in the outside rows. In addition, the upper stepped loader head 110 lags the lower flat loader head 112 so that the upper articles will tilt backward in toward the stepped loader head 110.

At the apex position 114 of approach of each arm assembly 42, the fixed face member 96 and extensible face member 98 are both shown to move in relation to the flat lower loader head 112. Shortly thereafter, the extensible face member 98 is shown to move from a retracted position with respect to the fixed face members 96 to an extended position, wherein it is nearly flush with the fixed face members 96. This occurs at the point the article groups 14 are fully inserted into the carton sleeve 16. It is this extension which aligns the article group rows with one another, resulting in a normal article group. The extensible face member 98 is controlled by the cam assembly 52 via the pivot arm 120. The cam assembly 52 simultaneously controls the transverse reciprocation of the entire loader arm assembly 42.

A pivot arm 120 is disposed at the actuation end 116 of the arm assembly 42. Importantly, the pivot arm 120 cooperates with the cam assembly 52 to actuate the fixed face members 96 and the extensible face member 98. The pivot arm 120 has a bar-shaped horizontal member 122 having two sections separated by a pivoting joint 124. The two sections are a backing pivot member 126 and an extensible pivot member 128. Cylindrical vertical members 130 connect the base plate 70 to the first cam follower 86 through one end of the pivot arm 120, connects the backing connection rod 92 to the second cam follower 90 through the pivoting joint 124 of the pivot arm 120, and connects the extensible connection rod 106 to the third cam follower 108 through the other end of the pivot arm 120. The longitudinally moving cam followers 86, 90, and 108 cooperate with the cam assembly 52 to cause both the backing pivot member 126 and extensible pivot member 128 to pivot and to thereby move the connection rods 92 and 106 relative to the longitudinal axis of the arm assembly 42. This in turn actuates the fixed 96 and extensible 98 face members of the loading head 72.

The loading head 72 configuration is variable to interface with a wide range of article group configurations. Although in the instant embodiment the head is configured for use with a 3 by 5 configuration, the head 72 can be modified for cartoning six packs, twelve packs, twenty-four packs and various other product group arrangements, including stacked configurations. The essential feature of the head 72 is that the face members 96 and 98 contacting the end articles alternate between fixed-type members and extensible-type members so that the container rows may be initially staggered for loading purposes. Head modification is accomplished by changes in the configuration of the face members and their placement on the backing plate 94. The head configuration may also accommodate various article sizes, types and configurations. The modification of the offset between the upper 110 and lower 112 loader heads is accomplished by adapting how the cam followers 86, 90, 108 react to the control cam assembly 52.

The control cam assembly 52 controls the transverse, reciprocal motion of both the overall arm assemblies 42 and the extensible face members 98. The control cam assembly 52 is generally oriented longitudinally with respect to the overall article group loading mechanism 10, and has a top or downstream run 54 and a bottom or return run 56 corresponding to the revolving arm assemblies 42. The top run 54 basically comprises an inwardly sloping approach segment 132, an active segment 134 located at the apex 114 of the approach segment 132 and involving a change in direction thereof and an outwardly sloping return segment 136. In the approach segment 132, the first or arm cam follower 86 is urged inwardly, with respect to the apparatus 12, and drives each arm assembly 42 into moving engagement with an article group 14 until the lower article group 36 is loaded into a carton. At this point the cam follower 86 is at the apex position 114 of the cam assembly 52. The second or fixed face member cam follower 90 and the third or extensible member cam follower 108 is also guided inwardly in the approach segment 132, but since they are is linearly aligned and traveling along with the first cam follower 86, no relative movement exists between these two elements. In contrast, as each arm assembly 42 reaches the apex 114 of the cam assembly 52, the first cam follower 86 moves out of linear alignment with the second 90 and third 108 cam follower. The first cam follower 86 no longer moves the arm assembly 86 in a transverse direction, and instead it is propelled only longitudinally. However, the spacially trailing second 90 and third 108 cam followers continue to undergo transverse movement due to the inwardly sloping approach segment 132, causing the pivot arm 120 to pivot and thereby activate the fixed face member 96 extensible member 98. The second cam follower 90 reaches the apex and no longer moves in a transverse direction, and instead it is propelled only longitudinally. However the spacially trailing third cam follower 108 continues to undergo transverse movement due to the approach segment 132, thereby extending the extensible member 98 even further. In the outwardly sloping return segment 136, a complete pivot of the pivot arm 120 is accomplished, with resultant full extension of the extensible member 98. Throughout this segment 136, the cam followers 86, 90, and 108 are once again linearly aligned during travel and therefore no further relative motion occurs. The arm assembly 42 is retracted by the outward movement of the first cam follower 86. In the bottom run 56 of the cam assembly 52, the arm assemblies 42 are longitudinally returned to the top run 54. Additionally, the pivot arm 120 is reset in the bottom run 56 to its original position in the approach segment 132. The top run 54 of the cam assembly 52 comprises a continuous inner rail 138 which extends the entire length of the top run 54, and an outer rail 140 which extends the length of the approach segment 132 and is spaced from the inner rail 138 a distance equivalent to the diameter of the second 90 and third 108 cam follower. The second 90 and third 108 cam follower are disposed in a cam pathway between the inner 138 and outer 140 rails to effectuate transverse, inward motion of the arm assemblies 42.

Preferably, the outer rail 140 is connected to a pivot point 142 at its first end. Its opposite end is connected to a release mechanism 144, such as a pressure release cylinder and piston. The release mechanism 144 is controlled by a sensing mechanism, for example, a photoeye or capacitive proximity sensor, such that if an excessive force is placed on the outer rail 140, for example due to a jamming of the arm assembly 42, the release mechanism 144 will actuate and release the pivoting outer rail 140.

The descriptions above and the accompanying drawings should be interpreted in the illustrative and not the limited sense. While the invention has been disclosed in connection with the preferred embodiment or embodiments thereof it should be understood that there may be other embodiments which fall within the scope of the invention as defined by the following claims. Where a claim is expressed as a means or step for performing a specified function it is intended that such claim be construed to cover the corresponding structure, material, or acts described in the specification and equivalents thereof, including both structural equivalents and equivalent structures.

That which is claimed is:

1. An article group transfer mechanism for use in a continuous motion cartoner assembly, comprising:

(a) a frame structure;

(b) a plurality of transfer elements disposed at predetermined longitudinally spaced intervals, said transfer elements being for laterally moving articles which are being longitudinally transported in at least one stream of the cartoner assembly, each said transfer element including a stepped loading head for moveable contact with an article group, the stepped loading head having a fixed face member attached to a backing plate, the backing plate having an opening and an extensible face member with a tail portion extending through said opening in said backing plate, said transfer element further including a support member connected to said stepped loading head and a control member for directing the lateral movement of said transfer elements, said control member having a first cam follower connected to said support member and controlling lateral movement of said transfer elements, a second cam follower pivotally connected to said support member and further being connected to said backing plate via linkage means, said second cam follower providing differential lateral movement to said fixed face member, a third cam follower pivotally connected to said second cam follower and further being connected to said tail portion of said extensible member via linkage means, said third cam follower providing differential lateral movement to said extensible face member;

(c) means to longitudinally move said transfer elements, said longitudinal movement means being connected to said support member; and (d) a cam track assembly having a predetermined configuration for laterally moving said transfer elements, said cam track assembly being cooperatively mated with said first, second and third cam followers.

2. The mechanism of claim 1, wherein said transfer elements are constructed and arranged along an endless longitudinally oriented loop to be conveyed longitudinally in a top, forward run and a bottom, return run on said frame structure.

3. The mechanism of claim 1, wherein said support member comprises a laterally oriented, elongated base member having a first end at which said contact member is disposed and a second end, at least one bearing block disposed proximate each said base member end, and at least one slide rail aligned and disposed spacially parallel with respect to said base member and slidably mated with said bearing blocks, said slide rail further being connected to said longitudinal movement means.

4. The mechanism of claim 1, wherein said stepped loader head has is an upper stepped loader head, said transfer element further including a lower flat loader head fixedly attached to said support member, said first cam follower controlling the lateral movement of said transfer elements.

5. The mechanism of claim 4, wherein said cam track assembly has an inwardly sloping approach segment having an apex, an action segment located at said apex, and an outwardly sloping return segment, said first cam follower leads said second cam follower by a predetermined distance and said second cam follower leads said third cam follower by a predetermined distance through said approach segment, said active segment, and said return segment, said lower flat loader head leads the upper stepped loader head in said approach segment, and said fixed face member of said upper stepped loader head leads said extensible face member in said approach segment, active segment, and return segment, said lower fixed plate being in contact with a lower group, said upper stepped loader head being in contact with a nested upper article group having staggered rows of articles, said fixed face member being in contact with at least one row of said upper article group and said extensible face member being in contact with at least one row of said upper article group, whereby said lower flat loader head inserts said lower group into said carton in said active segment and moves away from said carton in said return segment, then said fixed face member inserts said rows into said carton in said active segment and moves away from said carton in said return segment, and then said extensible member extends and inserts said rows into said carton in said active segment and moves away from said carton in said return segment.

6. A loader arm assembly for use in an article group transfer mechanism of a continuous motion cartoner assembly, comprising:

(a) a loading head for moveable contact with articles, said loading head including a stepped upper loader head and a flat lower loader head, said stepped loader head having a fixed face member attached to a backing plate and an extensible face member, said backing plate having an opening, said extensible face member has a tail portion extending through said opening in said backing plate, (b) a support member connected to said loading head;

(c) a control member for directing lateral movement of transfer elements, said control member having a first cam follower connected to said support member and controlling lateral movement of said loader arm assembly, a second cam follower pivotally connected to said support member and further being connected to said backing plate via linkage means, said second cam follower providing differential lateral movement to said fixed face member, and a third cam follower pivotally connected to said second cam follower and further being connected to said tail portion of said extensible face member via linkage means, said third cam follower providing differential lateral movement to said extensible face member, whereby said flat lower loading head has an initial lateral offset with said stepped upper loading head and said fixed face member of the upper loading head has an initial offset with said extensible face member of said upper loading head, wherein the differential lateral movements produced by said first, second, and third cam followers remove the offset of an upper article group with respect to a lower article group and remove a staggered pattern of nested configuration when both the upper and lower article groups are inserted into a carton.

7. A continuous motion cartoning apparatus for loading article groups into cartons, comprising:

(a) an article group transport mechanism constructed and arranged to transport a longitudinal stream of article groups;

(b) a carton transport mechanism disposed adjacent to and parallel with said article group transport mechanism, said carton transport mechanism being constructed and arranged to provide a longitudinal stream of carton sleeves with open ends facing and synchronized with said article group transport mechanism; and (c) an article group loading mechanism constructed and arranged to move a plurality of article groups from said article group transport mechanism into a plurality of carton sleeves traveling on said carton transport mechanism; said article group loading mechanism having a loading head for moveable contact with articles, said loading head including a stepped upper loader head and a flat lower loader head, said stepped upper loader head having a fixed face member attached to a backing plate and an extensible face member, said backing plate having an opening, said extensible face member has a tail portion extending through said opening in said backing plate; a support member connected to said loading head; a control member for directing lateral movement of transfer elements, said control member having a first cam follower connected to a support member and controlling lateral movement of a loader arm assembly, a second cam follower pivotally connected to said support member and further being connected to said backing plate via linkage means, said second cam follower provides differential lateral movement to said fixed face member, and a third cam follower pivotally connected to said second cam follower and further being connected to said tail portion of said extensible face member via linkage means, said third cam follower providing differential lateral movement to said extensible face member.

8. A method for loading stacked article groups, having an upper and lower article groups separated by a divider sheet, the upper and lower article groups having rows, comprising the steps of:

(a) engaging the lower article group with a flat loader head and moving the article group so that articles in the upper article group tilts backward;

(b) engaging the upper article group with an upper loader head and creating a differential lateral offset between said upper article group and said lower article group;

(c) loading the stacked article group into a carton while maintaining the lateral offset between the lower and upper article groups until the lower article group is fully inserted into the carton; and (d) continuing to load the upper article group until predetermined rows of the upper group are fully inserted into the carton, whereby said method for loading stacked article groups loads bottles and other difficult articles into taut cartons.

9. The method of claim 8, further comprising the steps of staggering rows in said upper article group to form a nested article group having thinner, differential article group dimensions for easier loading into cartons, and removing the staggered pattern the nested upper article group by pushing predetermined staggered rows forward until they are fully inserted.

* * * * *